US009056758B2

(12) United States Patent
Clusserath

(10) Patent No.: US 9,056,758 B2
(45) Date of Patent: Jun. 16, 2015

(54) FILLING ELEMENT, AND FILLING SYSTEM OR FILLING MACHINE

(75) Inventor: Ludwig Clusserath, Bad Kreuznach (DE)

(73) Assignee: KHS GmbH, Dortmund (DE)

( * ) Notice: Subject to any disclaimer, the term of this patent is extended or adjusted under 35 U.S.C. 154(b) by 129 days.

(21) Appl. No.: 13/812,275

(22) PCT Filed: May 17, 2011

(86) PCT No.: PCT/EP2011/002430

§ 371 (c)(1),
(2), (4) Date: Jan. 25, 2013

(87) PCT Pub. No.: WO2012/016604

PCT Pub. Date: Feb. 9, 2012

(65) Prior Publication Data

US 2013/0126043 A1 May 23, 2013

(30) Foreign Application Priority Data

Aug. 3, 2010 (DE) ..... 10 2010 033 168

(51) Int. Cl.
*B67C 3/22* (2006.01)
*B67C 3/26* (2006.01)
*B67D 3/00* (2006.01)

(52) U.S. Cl.
CPC ..... *B67C 3/2608* (2013.01); *B67D 3/0058* (2013.01)

(58) Field of Classification Search
CPC ..... B67C 3/2608; B67C 3/286; B67D 3/0058
USPC ..... 141/115, 286, 311 A, 392, 301–302; 222/571
See application file for complete search history.

(56) References Cited

U.S. PATENT DOCUMENTS

| | | | | |
|---|---|---|---|---|
| 4,387,748 | A | 6/1983 | White | |
| 4,410,108 | A | 10/1983 | Minard | |
| 4,711,277 | A * | 12/1987 | Clish | 141/311 A |
| 6,076,750 | A * | 6/2000 | Mykkanen et al. | 239/584 |
| 7,308,917 | B2 * | 12/2007 | Krulitsch | 141/198 |
| 2006/0289078 | A1 * | 12/2006 | Wingens et al. | 141/57 |

(Continued)

FOREIGN PATENT DOCUMENTS

| | | |
|---|---|---|
| DE | 1288935 | 2/1969 |
| DE | 2246176 | 4/1974 |
| EP | 0860361 | 8/1998 |

(Continued)

*Primary Examiner* — Timothy L Maust
*Assistant Examiner* — Timothy P Kelly
(74) *Attorney, Agent, or Firm* — Occhiuti & Rohlicek LLP

(57) ABSTRACT

A filling element for filling containers with a lumpy liquid filler includes a liquid valve that is arranged in a liquid channel in an interior of a filling element housing and that is formed by a first valve surface, cooperating with a first valve seat, on a valve body that is movable along a filling-element axis to open and close the liquid valve, and that comprises at least two dispensing openings on filler flow channels, the dispensing openings forming a filler outlet. The filler flow channels are in flow communication with the liquid channel and with each other when the liquid valve is open and are separated from each other and from the liquid channel when the liquid valve is closed. The element also includes a separate valve arrangement that separates the filler flow channels from each other in flow terms when the liquid valve is closed.

9 Claims, 2 Drawing Sheets

(56) References Cited

U.S. PATENT DOCUMENTS

| | | | | |
|---|---|---|---|---|
| 2012/0186695 | A1* | 7/2012 | Clusserath | 141/115 |
| 2012/0298251 | A1* | 11/2012 | Clusserath et al. | 141/1 |

FOREIGN PATENT DOCUMENTS

| | | |
|---|---|---|
| EP | 0919472 | 6/1999 |
| JP | 2004083043 | 3/2004 |

* cited by examiner

FILLING ELEMENT, AND FILLING SYSTEM OR FILLING MACHINE

CROSS REFERENCE TO RELATED APPLICATION

This application is the national phase under 35 USC 371 of international application no. PCT/EP2011/002430, filed May 17, 2011, which claims the benefit of the priority date of German application no. 10 2010 033 168.6, filed Aug. 3, 2010. The contents of the aforementioned applications are incorporated herein in their entirety.

FIELD OF DISCLOSURE

The invention relates to a filling element for filling containers, in particular for the free-jet filling of containers with a liquid filler, for example with a lumpy filler.

BACKGROUND

A gas lock in the region of a filler outlet helps avoid dripping of the filling element after the filling process. Typical gas locks have bores or filler flow channels formed in the filling element or in an insert. For convenience in exposition, both bores and filler flow channels will be referred to as filler flow channels.

The filler flow channels extend parallel to a vertical or substantially vertical filling element axis and are open at both ends. The lower open ends of the filler flow channels form dispensing openings. During the filling process, filler flows from the dispensing openings in a free filling-jet towards a container to be filled.

The upper open ends or inlets of the filler flow channels cooperate with a flat, plunger-like valve body of a liquid valve. To end the filling process, this liquid valve is closed. This involves placing the valve body over all of the inlets, thus closing them off. Filler remaining in the filler flow channels after the closing operation is retained therein by virtue of a "pipette effect." This prevents the filling element from dripping.

A disadvantage of such gas locks is that they are not suitable for a lumpy filler that contains hard constituents. This is because the hard constituents accumulate between the inlets of the filler flow channels in the inflow region of the gas lock and form bridges. As filling continues, networks of hard filler constituents or fibers form over or in the inlets. Ultimately, these will block the inlets. This is a particular problem in the case of fruit juices, which have fibrous constituents having lengths of up to 20 mm. These constituent fibers can, on their own, clog bores or filler flow channels having a diameter of 10 mm.

A known way to avoid this problem is to use filling elements that form a free filling-jet using a single filler flow channel of large cross-section, This filler flow channel is disposed downstream of the liquid valve in the direction of flow of the filler. The diameter of the flow channel is at most 7 mm-9 mm. The liquid valve, which controls the flow of filler and/or the quantity of filler to be introduced into the container, and which consists essentially of a valve body having a valve surface and a valve seat cooperating with the valve surface, is provided upstream of an inlet of the single filler flow channel, as seen in the direction of flow of the filler.

A disadvantage of the foregoing arrangement is that only a relatively low filling rate can be achieved. With such a filling element, it is not possible to increase the filling rate by arranging a plurality of parallel filler flow channels of large diameter. This is because when such an arrangement is used, closing the liquid valve can no longer prevent emptying of the filler flow channels, and thus, an undesirable dripping of the filling element. This is because once the liquid valve is closed, the filler flow channels are connected to each other in the region of their inlets, and thus mutually vent each other. The resulting interconnected filler flow channels form a communicating pipe system. As a result, even extremely small differences in the quantities of filler remaining in the individual filler flow channels lead to a movement of the filler within this system, loss of the gas lock function, and emptying of the filler flow channels.

SUMMARY

An object of the invention is to provide a filling element that avoids the aforementioned disadvantages and also allows the container to be filled with lumpy filler while ensuring a high filling output and optimal shaping of the free filling jet.

One special feature of the invention lies in the fact that, in addition to the actual liquid valve, which is formed essentially by a first valve surface formed on a valve body and by a corresponding first valve seat, a further valve arrangement is provided. After the liquid valve has been closed, the further valve arrangement separates the inlets of the individual filler flow channels used for shaping the free filling jets and closes these inlets. As a result, the filler flow channels cannot form a communicating pipe system when the liquid valve is closed.

Even with a relatively large diameter of the filler flow channels (e.g. 7 mm-9 mm), the pipette effect, which is what prevents dripping, is fully maintained and the quantity of filler remaining in the respective filler flow channel once the liquid valve is closed is reliably retained in the channel. This effectively prevents any emptying of the filler flow channels and/or any dripping of the filling element once the liquid valve is closed.

In this case, the further valve arrangement is formed, for example, by a second valve surface that is offset spatially from the first valve surface. Preferably, the further valve arrangement is offset axially therefrom relative to a filling element axis. The further valve arrangement cooperates with a second valve seat, which is likewise offset spatially from the first valve seat, preferably along the filling element axis. This is preferable because the second valve surface will be located downstream of the first valve surface and the second valve seat will be located downstream of the first valve seat, as seen in the direction of flow of the liquid filler.

In one preferred embodiment, the second valve surface is provided on a valve body portion or on an element connected to the valve body. In one example, the second valve portion is provided on an outer or circumferential surface of the valve body portion or an element connected to the valve body. The valve seat is, for example, at least one surface that does not move with the valve body and against which the second valve surface bears to form a seal at least when the liquid valve is closed. The resulting seal is at least sufficient to close and to mutually block the filler flow channels and/or the inlets thereof to prevent a communicating pipe system and/or the effect of a communicating pipe system.

In one preferred embodiment of the invention, the filler flow channels are formed in the valve body, which also has the first valve surface. In this embodiment, in the closed state of the liquid valve, the valve body portion bears against an inner surface of the filling element or filling element housing that forms the second valve seat, thus closing the inlets of the filler flow channels.

As used herein, a "lumpy filler" is a filler or product that contains both a liquid component and hard or harder constituents, for example including fruit fibers and/or fruit pieces or pulp, with a fruit juice as the liquid component.

As used herein, the term "container" includes cans and bottles made from metal, glass and/or plastic, as well as other packaging means that are suitable for filling with liquid or viscous products, in particular also for a free-jet filling of containers with such products.

As used herein, "substantially" means deviations of ±10%, and preferably ±5% from an exact value in each case, and/or deviations in the form of changes that have no effect on function.

As used herein, "free-jet filling" means having the liquid filler flow towards the container to be filled in a free filling jet, with the container not bearing with its container mouth or opening against the filling element but rather being spaced apart from the filling element or from a filler outlet thereon.

Further developments, advantages, and possible uses of the invention will also become apparent from the following description of examples of embodiments and from the figures. All the features described and/or shown form in principle, per se or in any combination, the subject matter of the invention, regardless of the way in which they are combined in the claims or the way in which they refer back to one another. The content of the claims is also included as part of the description.

BRIEF DESCRIPTION OF THE FIGURES

The invention will be explained in more detail below with reference to the figures and on the basis of an example of embodiment. In the figures.

DETAILED DESCRIPTION

Figure 1:
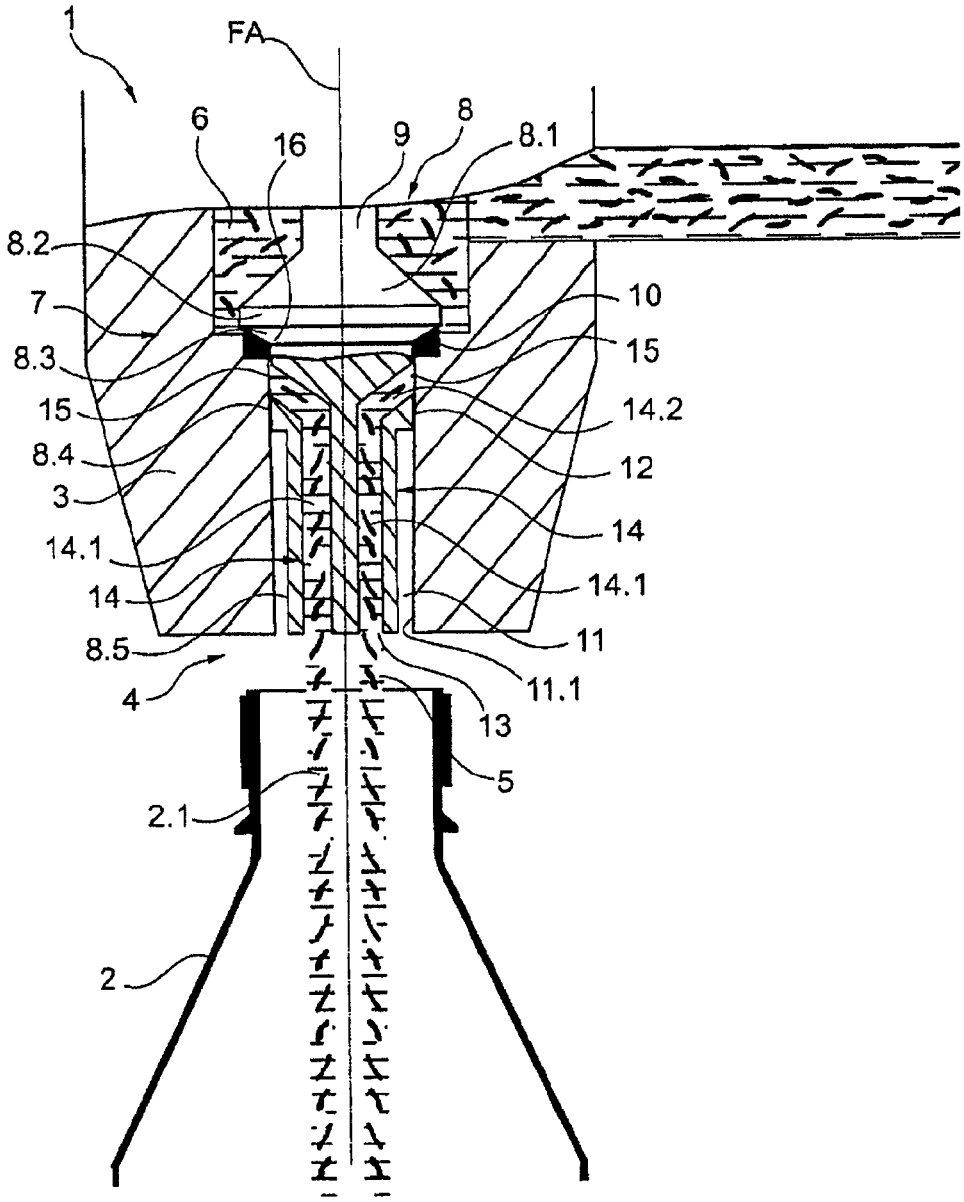
FIG. 1 shows in a simplified partial view a filling element of a filling machine or filling system for the free-jet filling of containers with a lumpy filler, together with a partial view of a container in the form of a bottle arranged below the filling element.

FIG. 1 shows a filling element 1 for the free-jet filling of containers, such as bottles 2. During the filling process, a container or bottle carrier (not shown) holds a bottle 2 with its container or bottle opening 2.1 at a distance below the filling element 1 or below a filler outlet 4 formed on the underside of the filling element 1 or on a filling element housing 3. As a result, during the filling process, a free filling jet 5 of liquid filler flows through the bottle opening 2.1 and into the bottle 2.

A filler channel or liquid channel 6 is formed in the filling element housing 3. The filler, or components forming the filler, is fed to the filler channel or liquid channel 6, for example in an upper region thereof. A liquid valve 7 is provided in the liquid channel 6. The liquid valve 7 can be opened and closed for the controlled dispensing of filler into a bottle 2.

The liquid valve 7 has a valve body 8 at the lower end of a valve plunger 9 that is oriented with its longitudinal axis along a vertical filling element axis FA. An actuating mechanism (not shown) moves the valve plunger 9 in a predefined stroke along the filling element axis FA. This up and down movement of the valve plunger 9 opens and closes the liquid valve 7.

In the illustrated embodiment, the valve body 8 has five distinct valve body portions. Starting from the lower end of the valve plunger 9 and proceeding downward toward the bottle 2, the valve body 8 comprises a first valve body portion 8.1, a second valve body portion 8.2, a third valve body portion 8.3, a fourth valve body portion 8.4, and a fifth valve body portion 8.5.

The first valve body portion 8.1 is a truncated cone with its base facing the bottle 2. The second valve body portion 8.2 is a substantially circular-cylindrical valve body portion. The third valve body portion 8.3 is also a truncated cone, but with its base facing away from the bottle 2. The fourth valve body portion 8.4 is a substantially circular-cylindrical valve body portion. The fifth valve body portion 8.5 is also a circular-cylindrical valve body portion, but with an external diameter that is smaller than the external diameter of the fourth valve body portion 8.4.

In a closed state of the liquid valve 7, shown in FIG. 1, the cone surface of the third valve body portion 8.3 forms a first valve surface that bears against a first valve seat 10 provided on the inner surface of the liquid channel 6. This forms a ring seal or seat seal. As a result of this seal, there is no flow connection between the liquid channel 6 and the filler outlet 4.

On the underside of the filling element housing 3 is an opening 11 that is coaxial with the filling element axis FA and that opens into the liquid channel 6 in the region of the valve seat 10. The opening 11 has an internal cross-section that is adapted to the external cross-section of the fourth valve body portion 8.4 in such a way that, at least in the closed state of the liquid valve 7, the outer surface of the fourth valve body portion 8.4 bears as tightly as possible against an inner surface 11.1 of the opening 11 to form a seal.

In the illustrated embodiment, moving the valve body 8 downward along the filling element axis FA closes the liquid valve 7. In this configuration, which is that shown in FIG. 1, the opening 11 fully accommodates the fourth and fifth valve body portions 8.4 and 8.5.

In contrast, moving the valve body 8 upwards along the filling element axis FA opens the liquid valve 7. In this configuration, an upper axial partial length of the fourth valve body portion 8.4 lies above the valve seat 10. Only a lower axial partial length of the fourth valve body portion 8.4 still lies within the opening 11.

As the liquid valve 7 opens and closes, the fourth valve body portion 8.4 moves in and out of the opening 11 like a piston. Opening the liquid valve 7 pulls its axial upper partial length out of the opening 11 and into the liquid channel 6. Closing the liquid valve 7 moves its upper axial partial length back into the opening 11.

A seat seal or ring seal 12 is provided on the outer surface of the fourth valve body portion 8.4 at the transition between the fourth and fifth valve body portions 8.4, 8.5. The seat seal or ring seal 12 concentrically surrounds the filling element axis FA and bears against the inner surface 11.1. In doing so, it seals off the gap between the inner surface 11.1 and the outer surface of the fourth valve body portion 8.4.

In the illustrated embodiment, dispensing openings 13 form the filler outlet 4. These dispensing openings 13 are openings of corresponding filler flow channels 14 that are provided in the fourth and fifth valve body portions 8.4, 8.5.

The dispensing openings 13 are located on the lower end of the valve body 8 or the fifth valve body portion 8.5. In the illustrated embodiment, the lower end is flat or substantially flat and oriented in a plane perpendicular to the filling element axis FA.

The filler flow channels 14 are disposed at uniform angular spacings around the filling element axis FA at a radial distance therefrom. Each filler flow channel 14 has a larger partial length 14.1 and a smaller partial length 14.2. The larger partial length 14.1 extends from the flow channel's corresponding dispensing opening 13 upwards in a direction parallel to the filling element axis FA. The smaller partial length 14.2 extends from the upper end of the larger partial length 14.1 along a direction that is at an angle to the filling element axis FA. In doing so, the smaller partial length 14.2 defines, with the filling element axis FA, an acute angle that opens in an upward direction, which is towards the side facing away from the lower end of the valve body 8.

Each of the smaller partial lengths 14.2 end at the circumferential or outer surface of the fourth valve body portion 8.4 in openings or inlets 15 that are distributed at uniform angular spacings around the filling element axis FA. Each inlet 15 has a center point. In the illustrated embodiment, these center points define a circle that concentrically surrounds the filling element axis FA. The inlets 15 are located above the ring seal 12. When the liquid valve 7 is closed, as shown in FIG. 1, the inlets 15 are located below the valve seat 10. In addition, the filler flow channels 14 are configured in such a way that the longitudinal extensions of the larger and smaller partial lengths 14.1, 14.2 of each filler flow channel 14 lie in a common plane. This common plane is radial to the filling element axis FA.

With the liquid valve 7 closed, the portion of the inner surface of the opening 11 that lies below the valve seat 10 closes each inlet 15. With the liquid valve 7 open, the openings 15 are located on the partial length of the fourth valve body portion 8.4 raised above the valve seat 10. As a result, the filler flow channels 14 are connected to the liquid channel 6 via the inlets 15. This means that when the liquid valve 7 is open, the filler can flow from the liquid channel 6 into the filler flow channels 14 and out from the latter through the filler outlet 4 or the dispensing openings 13 therein and into the respective bottle 2 as a free filling jet 5.

Due to the plurality of filler flow channels 14, given an optimal configuration of the free filling jet 5, optimal conditions are achieved when filling the bottle 2, in particular including with regard to the filling output.

As the liquid valve 7 is closed, not one but two flow connections are interrupted. First, the flow connection between the liquid channel 6 and the filler outlet 4 is interrupted. This interruption occurs when the third valve body portion 8.3 bears against the valve seat 10. Second, the flow connection into the filler flow channels 14 is interrupted. This interruption occurs when the outer surface of the fourth valve body portion 8.4 bears against the inner surface 11.1 to form a seal. Effectively, the outer surface of the fourth body portion 8.4 forms a second valve surface and the inner surface 11.1 forms a second valve seat. The net effect is that each filler flow channel 14 is individually closed at its corresponding inlet 15.

Once the liquid valve 7 is closed, the pipette effect retains any filler still located in the filler flow channels 14. The resulting impossibility of mutual venting of the filler flow channels 14 via the closed inlets 15 prevents having a communicating pipe system. This applies even when the filler channels 14 have a relatively large diameter. As a result, it is practical to use filler channels 14 with a diameter in the range between 7 mm and 9 mm. Such large diameters are useful because the flow cross-sections are larger, thus allowing higher flow rates and increasing throughput. Large diameters are also useful to avoid any clogging or blocking of the filler pathways within the filling element by hard or harder filler constituents, for example by fruit fibers and/or fruit pieces.

As the liquid valve 7 is closed, i.e. as the fourth valve body portion 8.4 is moved back into the opening 11, harder filler constituents that may have accumulated in the region of the inlets 15 shear off at the upper edge region 16 of the opening 11.

A significant advantage of the filling element 1 arises because the plurality of filler flow channels 14 creates an optimal filling jet formation with a high filling rate, which results in a higher number of bottles being filled per unit time, even when the filler is a lumpy filler.

Another significant advantage is that, once the liquid valve 7 has been closed, the filler flow channels 14 cannot empty. This means the filling element 1 will not drip, even when the filler flow channels 14 have a relatively large cross-section.

In one preferred embodiment of the invention, the actuating mechanism that actuates the valve body 8 via the valve plunger 7 is configured in such a way that, for CIP cleaning and/or disinfection for example, the valve body 8 can be moved so far upwards beyond the normal stroke A that the fourth valve body portion 8.4 rises completely outside the opening 11. The lower end of the opening 11 is then closed, for example, by a closure cap or another closure element, and connected to the liquid channel 6 of enlarged total flow cross-section not only via the filler channels 14 but also via an annular channel that surrounds the valve body portion 8.5. This is useful for particularly intensive treatment of all the surfaces of the valve body 8 during CIP cleaning and/or disinfection.

Figure 2:
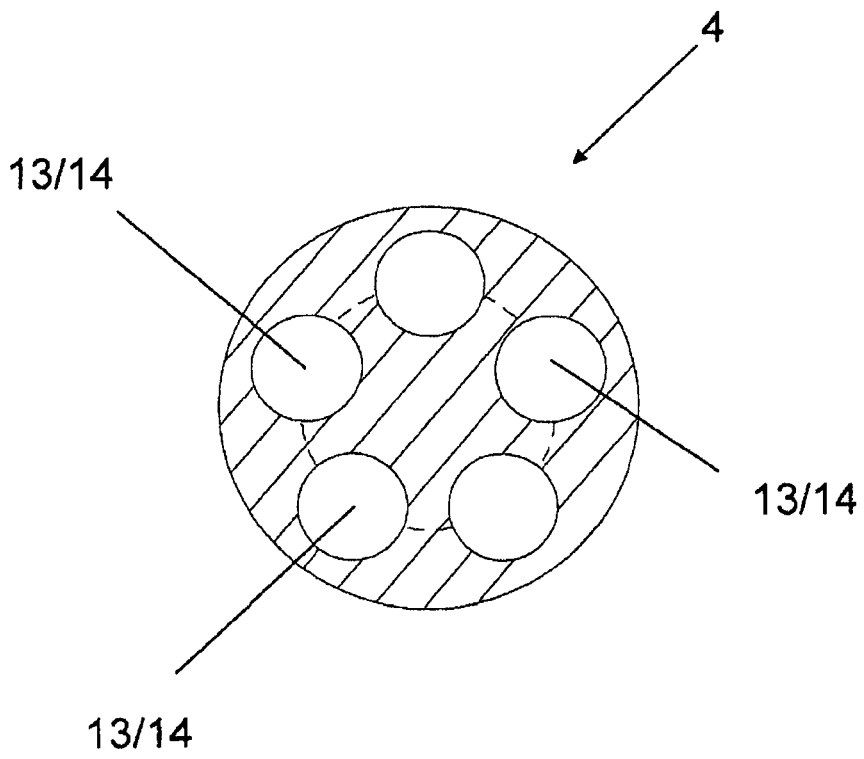
FIG. 2 shows a plan view of the underside of the filling element of FIG. 1 in the region of a filler outlet.

In alternative embodiments, the number and/or arrangement of the filler channels 14 differs from the number and/or arrangement shown in FIGS. 1 and 2.

Also among the embodiments are those that omit the ring seal 12. To achieve this, it is particularly advantageous to select the dimensions and tolerances of the cooperating components, namely of the inner wall of the opening 11 and the outer wall of the fourth valve body portion 8.4, in such a way that the upper inlets 15 of the filler flow channels 14 are hydraulically and pneumatically completely separated from each other when the filling valve is closed.

The invention has been described above on the basis of examples of embodiments. It will be understood that numerous changes and modifications are possible without thereby departing from the concept on which the invention is based.

The invention claimed is:

1. An apparatus comprising a filling element for filling containers with a lumpy liquid filler, said filling element comprising a liquid valve, filler flow channels, a separate valve arrangement, and at least two dispensing openings, wherein said liquid valve is arranged in a liquid channel in an interior of a filling element housing, wherein said liquid valve is formed by a valve body that has a first valve surface and that cooperates with a first valve seat, wherein said valve body is movable along a filling-element axis of said liquid valve to open and close said liquid valve, wherein said dispensing openings form a filler outlet, wherein said dispensing openings are provided on said filler flow channels, wherein said filler flow channels are in flow communication with said liquid channel and with each other when said liquid valve is opened and are separated with regard to flow from said liquid channel when said liquid valve is closed, and wherein said separate valve arrangement separates said filler flow channels from each other in flow terms when said liquid valve is closed.

2. The apparatus of claim 1, wherein said separate valve arrangement is formed by a second valve surface that is spatially offset from said first valve surface axially therefrom relative to said filling-element axis, and by a valve seat cooperating therewith that is spatially offset from said first valve seat axially from said first valve seat relative to said filling-element axis.

3. The apparatus of claim 2, wherein said filler flow channels each have at least one inlet via which said filler flow channels are connected to said liquid channel when said liquid valve is open, and wherein, when said liquid valve is closed, said filler flow channels are closed by one of said second valve surface and a second valve seat.

4. The apparatus of claim 3, wherein said inlets of said filler flow channels are arranged upstream of said first valve seat in a direction of flow of said filler when said liquid valve is open.

5. The apparatus of claim 3, wherein said filler flow channels are formed in one of said valve body and an element connected to said valve body in such a way that said inlets of said filler flow channels are provided on one of an outer surface and a circumferential surface of one of said valve body and an element connected to said valve body, downstream of said first valve surface in a direction of flow of said filler.

6. The apparatus of claim 5, wherein said filling element housing comprises one of a recess and an opening for accommodating a valve body portion of said one of said valve body and an element connected to said valve body that includes said inlets of said filler flow channels when said liquid valve is open such that at least one edge region surrounding a respective inlet of said one of an outer surface and a circumferential surface of one of said valve body and an element connected to said valve body bears against and seals an inner surface of said one of a recess and opening, said inner surface forming the second valve seat.

7. The apparatus of claim 6, wherein said valve-body portion is configured to be guided in a piston-like manner in said one of a recess and an opening.

8. The apparatus of claim 7, wherein said valve-body portion comprises one of a circumferential surface and an outer surface formed in a cylinder having a circular cross-section, and wherein said one of a recess and an opening is adapted to an external cross-section of said valve body portion at least over a partial length that, when said liquid valve is closed, accommodates said valve-body portion.

9. The apparatus of claim 1, wherein said filler flow channels, starting from said dispensing openings thereof, each have a longer partial length extending in a direction of said filling-element axis and a partial length having said inlet, and wherein longitudinal extensions of said partial lengths having said inlets each enclose, with said filling-element axis, an angle of less than 90° that opens towards a side facing away from said dispensing opening.

* * * * *